US005087853A

United States Patent [19]

Oguro et al.

[11] Patent Number: 5,087,853

[45] Date of Patent: Feb. 11, 1992

[54] MAGNETRON AND DIELECTRIC HEATER USING MAGNETRON

[75] Inventors: Tomokatsu Oguro; Mamoru Tsuzurahara; Hironobu Yamada, all of Mobara, Japan

[73] Assignee: Hitachi, Ltd., Tokyo, Japan

[21] Appl. No.: 424,197

[22] Filed: Oct. 19, 1989

[30] Foreign Application Priority Data

Oct. 26, 1988 [JP] Japan ..... 63-268043
Mar. 17, 1989 [JP] Japan ..... 1-63642

[51] Int. Cl.[5] ..... H01J 1/02; H01J 25/50; H01J 7/26; H05B 6/64

[52] U.S. Cl. ..... 313/45; 313/12; 313/22; 313/35; 219/10.55 R; 315/39.51

[58] Field of Search ..... 313/12, 22, 24, 35, 313/45; 219/10.55 R; 315/39.51

[56] References Cited

U.S. PATENT DOCUMENTS 3,577,033 5/1971 Aoki et al. ..... 313/45 X
3,936,766 2/1976 Staats ..... 315/39.53 X
4,123,643 10/1978 Burke ..... 219/10.55 R
4,164,684 8/1979 Oguro ..... 313/45 X
4,296,355 10/1981 Fukatsu et al. ..... 313/45 X
4,298,825 11/1981 Daikoku et al. ..... 313/45 X
4,310,786 1/1982 Kumpfer et al. ..... 315/39.51
4,661,669 4/1987 Matsushima et al. ..... 219/10.55 R
4,794,304 12/1988 Ito ..... 313/44 X

*Primary Examiner*—Donald J. Yusko
*Assistant Examiner*—Brian Zimmerman
*Attorney, Agent, or Firm*—Antonelli, Terry Stout & Kraus

[57] ABSTRACT

A magnetron having an anode cylinder, cooling fins fixed thereto, permanent magnets vertically superposed on the anode cylinder and a yoke, serving as a magnetic path, for surrounding these components. The cooling fins extend on the windward direction to facilitate a discharge of the air in the orthogonal direction to the air blowing direction by an arrangement such that an outer width of the fins and a width of the yoke or the former is equalized to a diameter of the anode cylinder. Also included are a dielectric heater having a heating space for accommodating materials for heating and a space for accommodating the magnetron, an inverter power supply and a cooling air blower. The cooling air is discharged to the heating space and/or to the outside via a vent hole formed in a partition wall after impinging on the anode cylinder while cooling the fins.

2 Claims, 6 Drawing Sheets

MAGNETRON AND DIELECTRIC HEATER USING MAGNETRON

BACKGROUND OF THE INVENTION

1. Field of the Invention

The present invention is directed to a dielectric heater, suitable particularly for an electronic cooking range, having a high efficiency of accommodating materials for heating as a system on the whole, the arrangement being such that an external configuration is formed to be flat, and a space for accommodating electronic appliances is considerably reduced as compared with a heating space in connection with the fact that an inverter system driving power supply is formed to be small.

The present invention further relates to a dielectric heater capable of preventing a remarkable decline in intensity of an interaction-space magnetic field of a magnetron whose dimension is orthogonal to a tubular axis of a frame-like yoke which serves as a draft air duct of cooling air, the decline being caused due to an increase in leakage magnetic fluxes leading from external surfaces of permanent magnets to an internal surface of the frame-like yoke.

2. Description of the Prior Art

A magnetron is typically cooled when being operated with being cooled. A conventional magnetron has such a structure that, as disclosed in, e.g., Japanese Utility Model Publication No. 54-35646, a yoke assuming a square in plan surrounds cooling fins closely fitted to an anode cylinder in a frame-like configuration, and the cooling air flows through an interior of the frame-like yoke while cooling the surfaces of the cooling fins. There arise, however, problems inherent in the conventional structure, such that (1) air passageways on both sides of the anode cylinder are narrowed when decreasing a lateral width in a ventilating direction with the result that the cooling process is effected with difficulty, and such that (2) after the cooling air has passed by the anode cylinder, the air does not immediately turn around the anode to the rear side of the anode cylinder, whereby there is not obtained a higher cooling efficiency than expected. For this reason, there is no choice but to increase the lateral width of the magnetron in the ventilating direction of the cooling air (ventilation flue).

On the other hand, a space for accommodating electronic components of an electronic cooking range exists so that its larger two sides are on the line of extension of a heating space. In the case of expanding a space for accommodating the materials for heating in the electronic cooking range, a length of one remaining side has to be reduced. It is required that the length of this remaining side be equal to or larger than a width of the air draft duct for the cooling air of the magnetron. When using a conventional magnetron driving power supply of such a system that a commercially available AC power supply is directly inputted to a step-up transformer for driving the magnetron, however, a large-sized transformer and also a large-sized oil-immersed capacitor are required, and these components have to be accommodated together with the magnetron in the electronic component accommodating space. As discussed above, when ensuring the large width of the ventilation flue of the magnetron, a capacity utilizing efficiency of the electronic component accommodating space is deteriorated. Besides, this space is large relative to the space for accommodating the materials for heating, resulting in deterioration in accommodation efficiency on the whole.

In recent years, an inverter power supply has been employed as a power supply for driving the magnetron. The inverter power supply contributes to considerable miniaturization of a transformer, inductors and capacitors. Owing to this inverter power supply, the electronic component accommodating space can remarkably be remarkably diminished as compared with the prior art magnetron driving power supply in which the commercially available AC power supply is inputted directly to the step-up transformer.

Even when making use of the foregoing inverter system driving power supply, however, it is, as explained earlier, required that the lateral width of the ventilation flue for the cooling air of the magnetron be large when being used in combination with the prior art magnetron. Consequently, there is created an additional problem in which the space for accommodating the electronic components of the electronic cooking range has to be much the same as that in the prior art.

SUMMARY OF THE INVENTION

It is a primary object of the present invention, which obviates the foregoing problems, to provide both a novel magnetron capable of diminishing a space for accommodating electronic components by making most of an advantage of miniaturization of an inverter system driving power supply and a dielectric heater, i.e., an electronic cooking range having a high efficiency of accommodating materials for heating.

To accomplish this object, according to one aspect of the invention, there is provided a magnetron comprising: an anode cylinder connected to an output fetching member extending in the direction of a cylinder axis; cooling fins closely fitted to an external wall thereof; permanent magnets superposed on an axial end of the anode cylinder; and a yoke serving as a magnetic return path around circumferences of the anode cylinder and the superposed permanent magnets, characterized in that the cooling fins are extended on the windward side of a direction in which cooling air is blown in asymmetry with respect to the line passing through the axis of the anode cylinder and perpendicular to the blowing direction of the cooling air, both an outer width of the cooling fin and a width of the yoke or the outer width of the cooling fin orthogonal to the air blowing direction is substantially equalized to a diameter of the anode cylinder, and the cooling air impinging on the anode cylinder to change its direction is arranged to be discharged with facility in a direction orthogonal to the air blowing direction.

To be specific, the yoke parallel with the anode cylinder axis is disposed orthogonally to the air blowing direction only on the leeward side of the cooling air with respect to the anode cylinder. A width of the yoke is substantially equalized to a diameter of the anode cylinder; or alternatively, the yoke parallel with the anode cylinder axis, which serves as a part of the side wall of a draft air duct of the cooling air, is disposed on the windward side from the anode cylinder (in this case, only the outer width of the cooling fin in the direction orthogonal to the air blowing direction is limitedly substantially equal to the diameter of the anode cylinder). In addition, the yoke is formed with an opening virtually causing no resistance to the air discharged after impinging on the anode cylinder to change its direction.

According to another aspect of the invention, there is provided a dielectric heater characterized in that: there are formed a heating space for accommodating materials for heating and an electronic component accommodating space sectioned by a partition wall adjacently to the heating space in a dielectric heater (such as an electronic cooking range); the electronic component accommodating space accommodates a magnetron, an inverter power supply (its external configuration is shaped flat corresponding to a reduced lateral width of the magnetron) for driving the magnetron and a cooling air blower; the cooling air blown from the air blower impinges on the anode cylinder of the magnetron after cooling the cooling fins of the magnetron, thus changing its direction; subsequently, the air passes through a vent hole perforated in the partition wall or the above-mentioned vent hole and a vent hole leading from the electronic component accommodating space to the outside; and the cooling air is then discharged to the heating space and/or the outside.

Based on the foregoing technique, however, if the side surface of the frame-like yoke is made close to a bulb body of the magnetron to such an extent that a vent hole is required to be formed in the yoke, there diminishes a distance between the inside of the side surface of the yoke and the outer surfaces of permanent magnets provided at upper and lower ends of the bulb body of the magnetron. As a result, the yoke serves as a route for a good deal of leakage magnetic fluxes with respect to the permanent magnets so magnetized that the upper and lower ends in the direction of the tubular axis bear different polarities. This in turn causes a probability that a tube-axial magnetic field intensity of the interaction space within the anode cylinder of the magnetron is decreased.

The magnetron according to the present invention is capable of preventing the frame-like yoke from becoming, as explained earlier, the route for a good deal of leakage magnetic fluxes with respect to the permanent magnets of the magnetron and also restraining a decline in intensity of the interaction-space magnetic field.

According to still another aspect of the invention, there is provided a magnetron characterized in that when the shortest distance between an interior of the yoke which is parallel with the tubular axis of the magnetron and external surfaces of the permanent magnets decreases under one-half of a thickness t of the permanent magnet in the tube axial direction, a height h of a remaining part of the yoke is set such as $h<t$, preferably $h<0.5$ t, the yoke remaining part leading to the yoke interior orthogonal to the tubular axial direction from an edge orthogonal to the tube axial direction of the vent hole, perforated in the side surface of the frame-like yoke, for discharging the cooling air the flow of which is turned due to hindrance of the anode cylinder.

When adopting the above-described means, the lateral width of a ventilation path of the cooling air of the magnetron is reduced down to a value substantially equal to a diameter of the anode cylinder, and correspondingly a size of the electronic component accommodating space of the dielectric heater is diminished. Besides, there is utilized an advantage of the small-sized inverter system driving power supply. On the other hand, the cooling air impinging on the anode cylinder changes its direction at a right angle, at which time the air is discharged. It is therefore possible even for a conventional air blower to blow a sufficient amount of air. Namely, the anode cylinder functions as an air guide for changing the direction of the cooling air while being cooled by the cooling air. A capacity utilizing efficiency of the space for accommodating the electronic components of the dielectric heater such as an electronic cooking range is remarkably improved, and a structure of the heater is also simplified. The space for accommodating the materials for heating can be enlarged, correspondingly.

Furthermore, the vent hole formed in the yoke actually extends over the portion positioned vis-a-vis with the ends of the permanent magnets on the side of the bulb body of the magnetron, with a narrow air gap being interposed therebetween which is smaller than one-half of the thickness of the permanent magnet. This arrangement eliminates the presence of an iron plate which is to serve as a route for the leakage magnetic fluxes, thereby restraining the generation of the leakage magnetic fluxes. Consequently, the interaction-space magnetic filed of the magnetron is intensified.

BRIEF DESCRIPTION OF THE DRAWINGS

Other objects and advantages of the present invention will become apparent during the following discussion taken in conjunction with the accompanying drawings, in which:

FIG. 1(*b*) is a side view thereof in the first embodiment;

FIG. 1(*c*) is a top view thereof in the first embodiment;

FIG. 1(*d*) is a top view illustrating a magnetron in a second embodiment;

FIG. 1(*e*) is a side view thereof in the second embodiment;

FIG. 1(*f*) is a front elevation thereof in the second embodiment;

FIG. 1(*g*) is a front elevation illustrating an electronic cooking range, in a third embodiment of the invention, on which the magnetron of the first embodiment is mounted;

FIG. 1(*h*) is a partially sectional side view thereof in the third embodiment;

FIG. 1(*i*) is a partially sectional top view thereof in the third embodiment;

FIG. 2(*b*) is a view showing a state of ventilation in the vicinity of a magnetron mounting portion of the electronic cooking range using the magnetron of the second embodiment;

FIG. 4(*b*) is a sectional view taken substantially along the line C—C' of FIG. 4(*a*)

DESCRIPTION OF THE PREFERRED EMBODIMENTS

Figure 1:
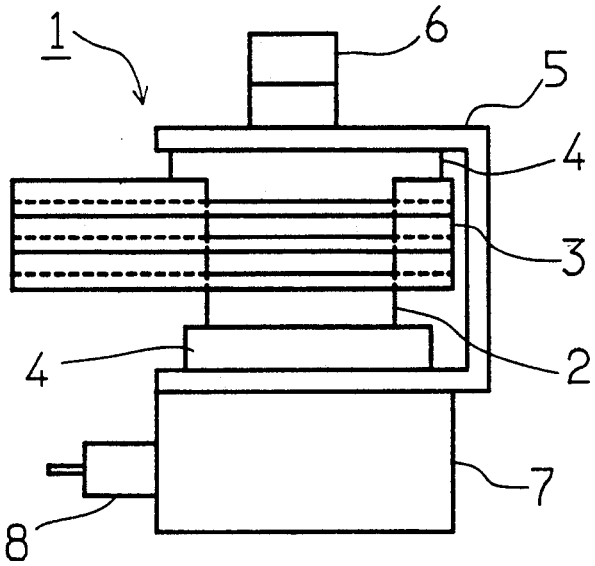
FIG. 1(*a*) is a front elevation depicting a magnetron in a first embodiment of the present invention.
Figure 1:
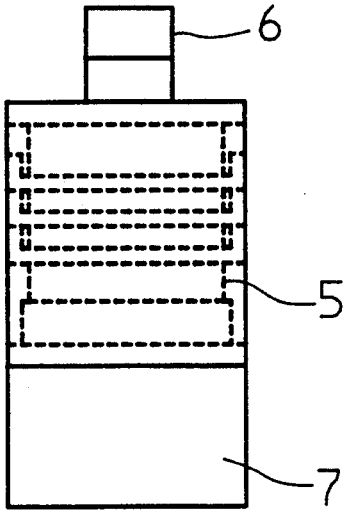
Figure 1:
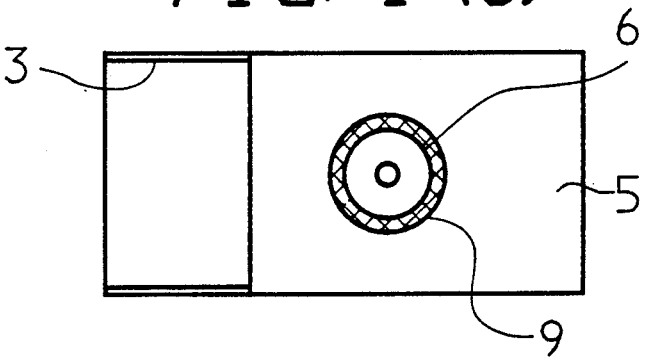
Figure 1:
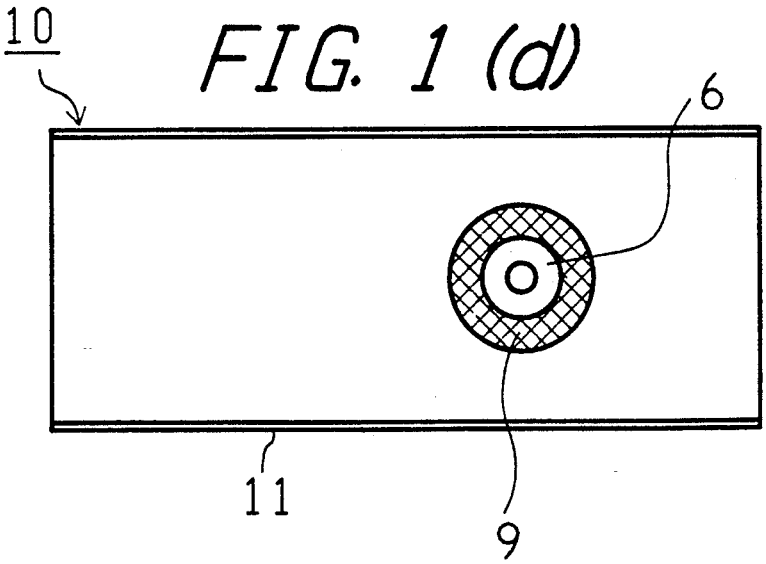
Figure 1:
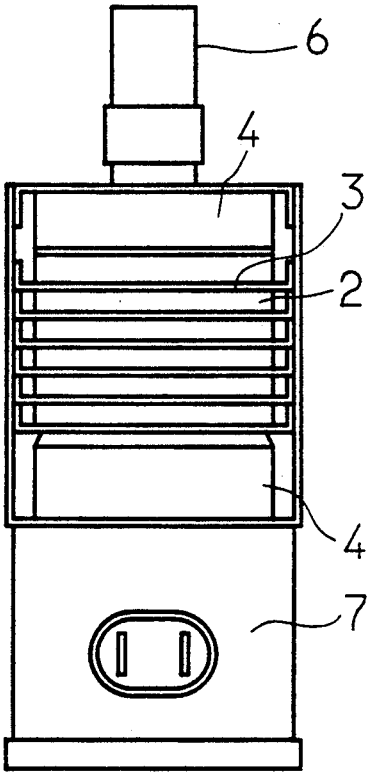
Figure 1:
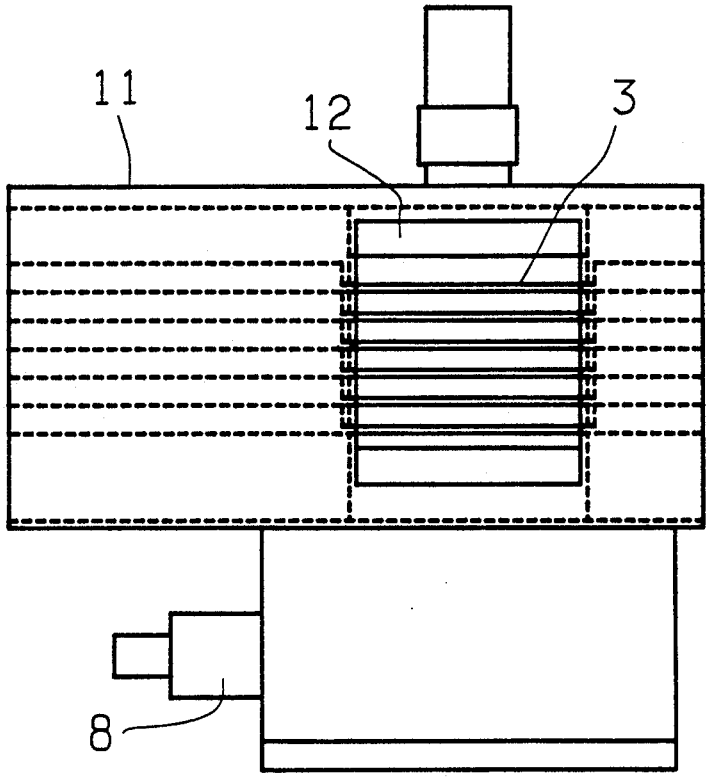
Figure 1:
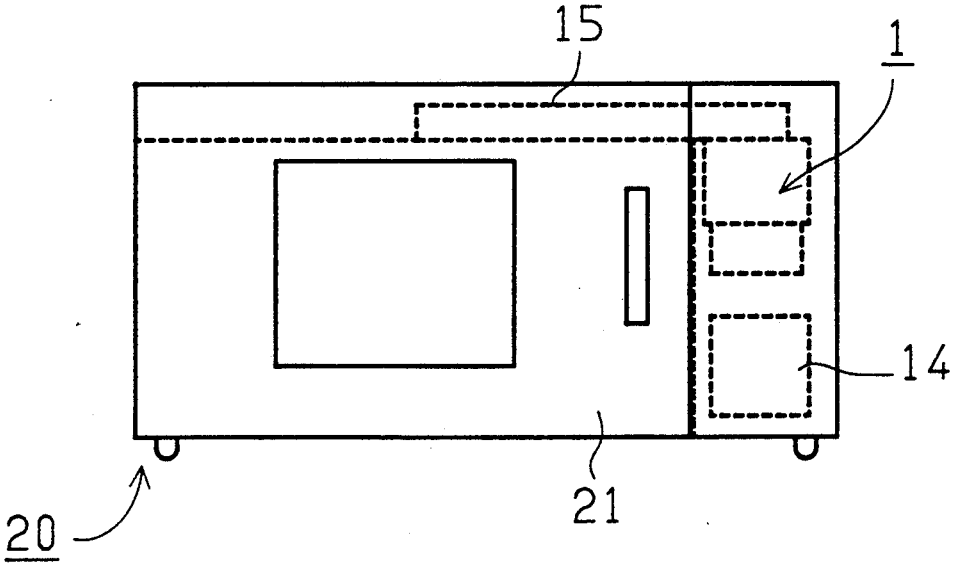
Figure 1:
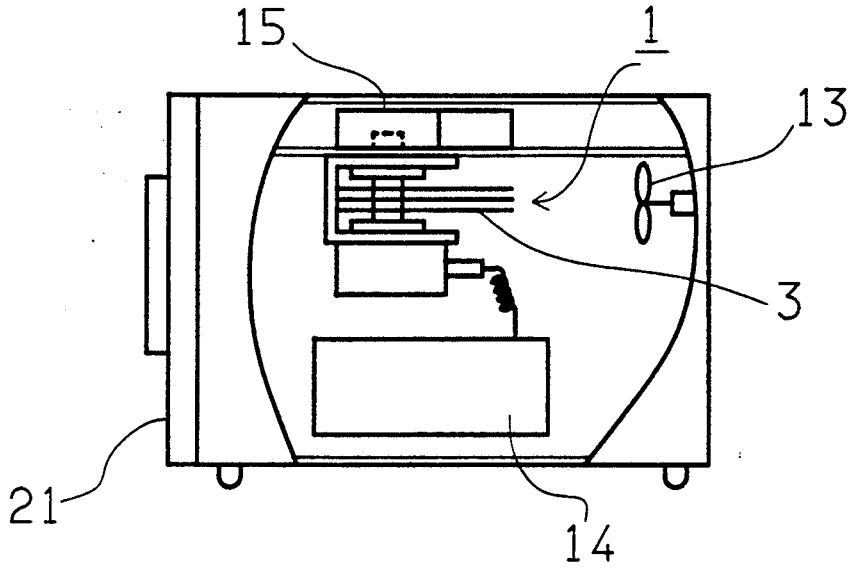
Figure 1:
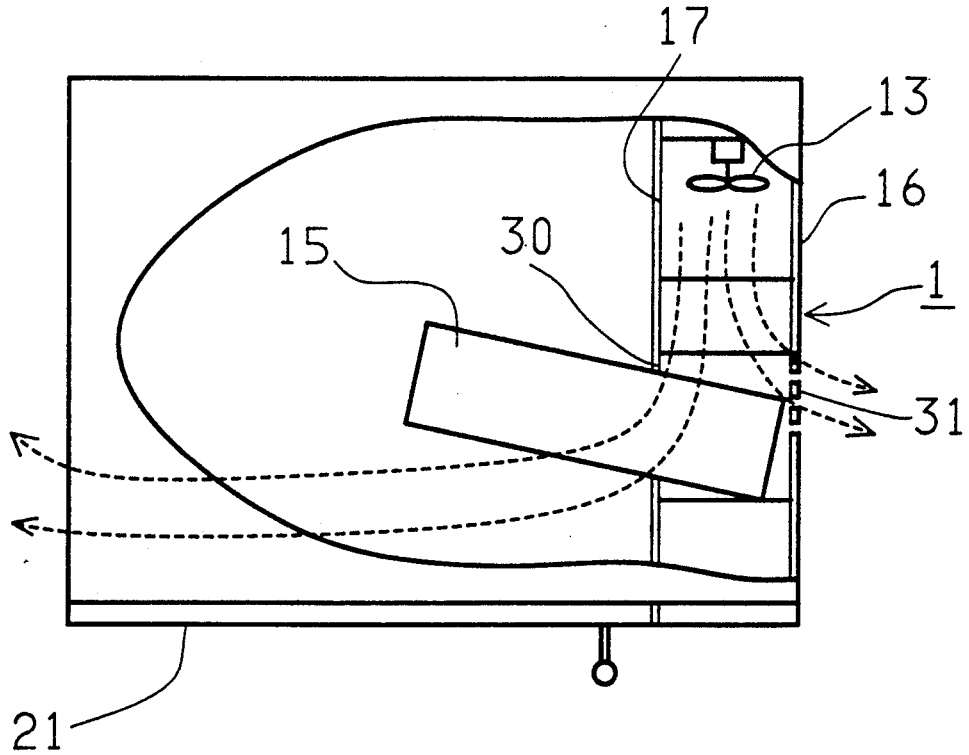

FIG. 1(*a*) is a front elevation depicting a magnetron in a first embodiment of the present invention. FIG. 1(*b*) is a side view thereof in the first embodiment. FIG. 1(*c*) a top view thereof in the first embodiment. Throughout these Figures, the numeral 1 designates the magnetron of the first embodiment. The numeral 2 represents an anode cylinder (body unit). Indicated at 3 are cooling fins which are press-fitted in the anode cylinder and have an outer width orthogonal to a cooling air blowing direction and substantially equal to a diameter of the anode cylinder. The numeral 4 denotes an annular ferrite magnet; 5 a frame-like yoke having its width orthogonal to the cooling air blowing direction and substantially equal to the diameter of the anode cylinder; 6 a member (antenna), penetrating the yoke and the magnet as well, for fetching microwave outputs from the anode cylinder; 7 a filter case (shield case), incorporating an unillustrated choke coil, for shielding an entire cathode input member of the body to prevent a leakage of unnecessary waves; and 9 a gasket, composed of a metal mesh, for preventing the leakage of the unnecessary waves by ameliorating a contact condition while filling a gap associated with a wavegide. Note that the cooling fins are so supported as to be forcibly fitted in the anode cylinder. The fitting portion requires a wall having a strength enough to support the fins over the entire periphery of the anode cylinder. Hence, a fin width is substantially equal to or slightly larger than a diameter of the anode cylinder. The yoke 5 assuming a frame-like configuration is so arranged that the cooling air, which impinges on the anode cylinder to change its direction, can freely be discharged. As is obvious from FIGS. 1(*a*) and 1(*b*), the cooling fins 3 exhibiting an asymmetry with respect to the anode cylinder line passing through the axis of the and perpendicular to the blowing direction of the cooling air extend toward the windward side of the cooling air, whereby the cooling air changes its direction and is then discharged at the anode cylinder. Although a small number of fins are provided on the leeward side, sufficient cooling effects are exhibited.

FIG. 1(*d*) is a top view illustrating a magnetron in a second embodiment of the invention. FIG. 1(*e*) is a side view thereof in the second embodiment. FIG. 1(*f*) is a front elevation thereof in the second embodiment. Throughout the Figures, the numeral 11 represents a yoke; and 12 an opening of the yoke. Other symbols are the same as those in the first embodiment. The yoke 11 particularly parallel with an anode cylinder axis is disposed, as a part of the side wall of a draft air duct of the cooling air, on the windward side from the anode cylinder. The yoke 11 is formed with an opening 12 causing virtually no resistance to the air to be discharged after impining on the anode cylinder to vary its direction. In this embodiment, the yoke completely surrounds the draft air duct of the cooling air, and hence an amount of air which directly cools the anode cylinder itself increases.

FIG. 1(*g*) is a front elevation depicting an electronic cooking range, in a third embodiment of the invention, on which the magnetron of the first embodiment is mounted. FIG. 1(*h*) is a partially sectional side view thereof in the third embodiment. FIG. 1(*i*) is a partially sectional top view thereof in the third embodiment. Throughout these Figures, the numeral 13 stands for a cooling air blower; 14 an inverter system driving power supply; 15 a waveguide for permitting radiation of microwave outputs of the magnetron from an upper portion of a heating space while guiding the microwave outputs; 16 an outer wall of the electronic cooking range (electronic component accommodating space) formed with an opening for discharging the cooling air; 17 a partition wall interposed between the electronic component accommodating space and the heating space; 20 an electronic cooking range in this embodiment; and 21 a door of the heating space. Other symbols are the same as those in the first embodiment. The cooling air at first cools the cooling fins 3 of the magnetron 1 and subsequently, as indicated by broken lines of FIG. 1(*i*), is split into two directions after impining on the anode cylinder to change its flow. One stream of air goes into the heating space via an opening 30 formed in the partition wall 17, whereas the other stream of air is discharged outside a cabinet via an opening 31 formed in the outer wall 16. The air, which has been warmed up by the magnetron and discharged into the heating space, acts to heat the materials for heating and at the same moment carries away steam emitted from the heated materials outside the electronic cooking range from an unillustrated opening, thus facilitating observation of the heated materials by causing no adhesion of moisture contents to the door glass.

The operations are the same as those in a case where the magnetron of the second embodiment is attached to the electronic cooking range (microwave oven).

Figure 2:
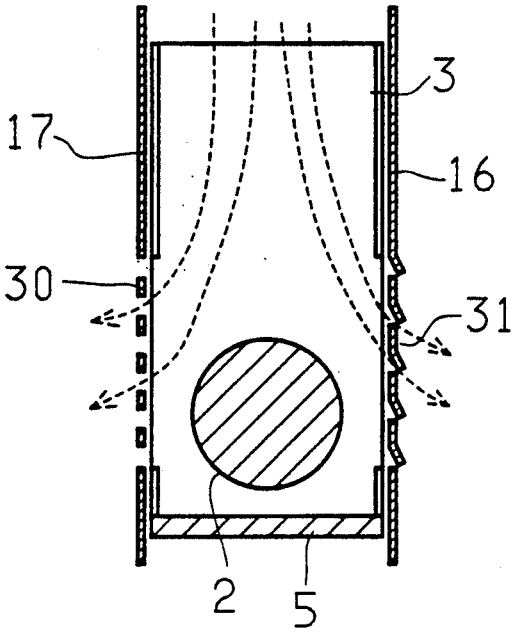
FIG. 2(*a*) is a view showing a state of ventilation in the vicinity of a magnetron mounting portion of the electronic cooking range using the magnetron of the first embodiment.
Figure 2:
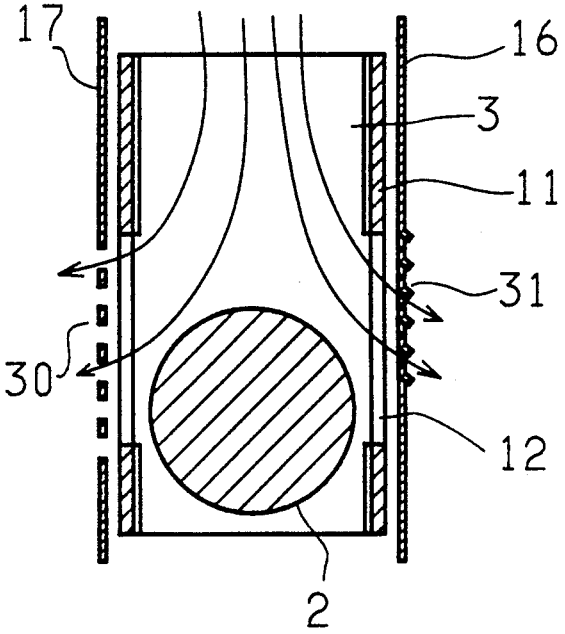
Figure 3:
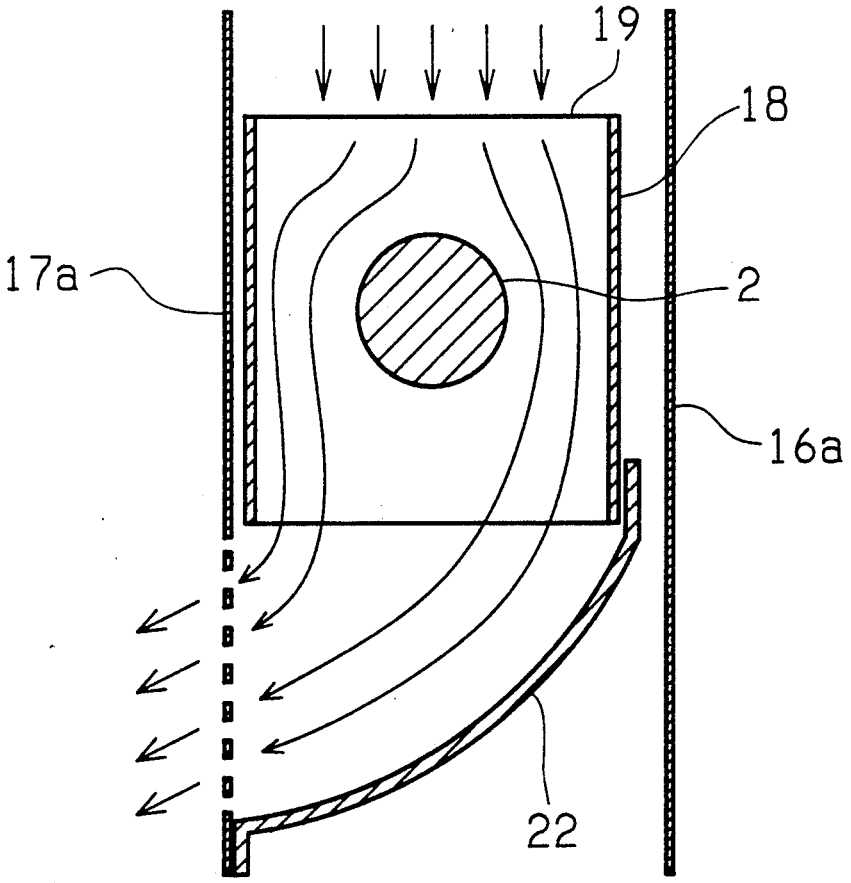
FIG. 3 (PRIOR ART)
FIG. 3 is a view showing a state of ventilation in the vicinity of a magnetron mounting portion of the electronic cooking range using a conventional magnetron.

FIG. 2(*a*) is a view showing a state of ventilation in the vicinity of a magnetron mounting portion of the electronic cooking range employing the magnetron of the first embodiment. FIG. 2(*b*) is a view showing a state of ventilation in close proximity to a magnetron mounting portion of the electronic cooking range using the magnetron of the second embodiment. For comparison, FIG. 3 illustrates a state of ventilation in the vicinity of a mounting portion of the electronic cooking range employing a conventional magnetron. In FIG. 3, the numeral 2 designates an anode cylinder; 16*a* an outer wall for the electronic cooking range; 17*a* a partition wall; 18 a conventional magnetron; 19 cooling fins of the conventional magnetron; and 22 an air guide. It can be understood from the illustrative comparison that when putting the present invention into a practical use, there is obtained a dielectric heater in which the lateral width of the magnetron can be reduced, the electronic component accommodating space is relatively small, while the space for accommodating the materials to be heated is large.

Figure 4:
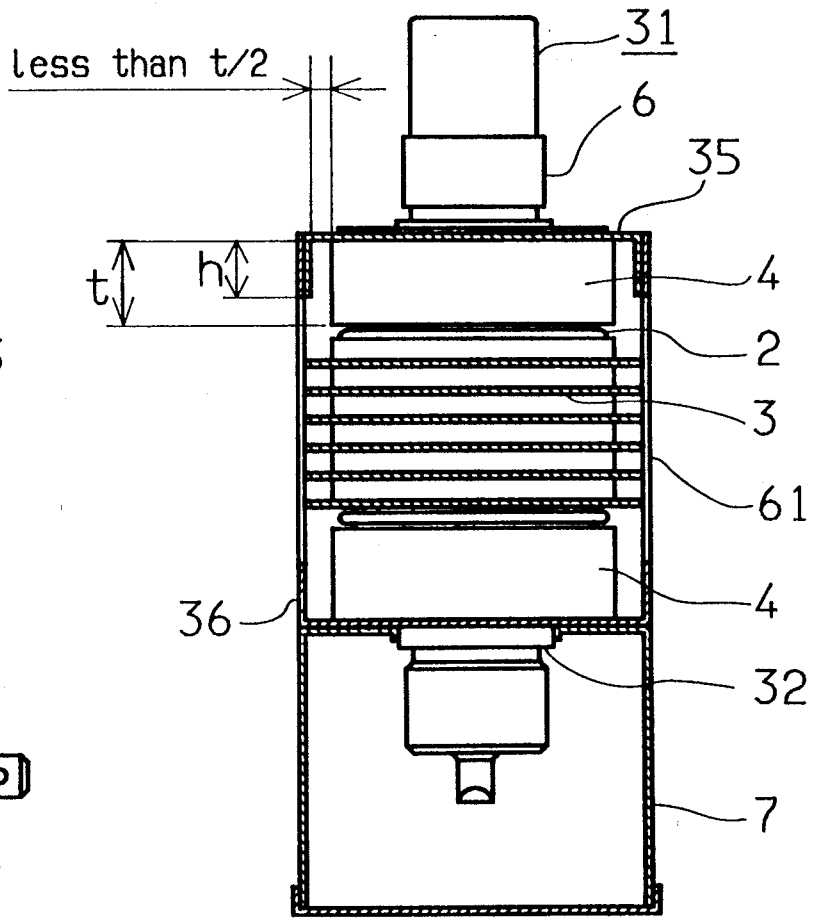
FIG. 4(*a*) is a front elevation depicting a side surface of a frame-like yoke perforated with a vent hole in a fourth embodiment of the invention.
Figure 4:
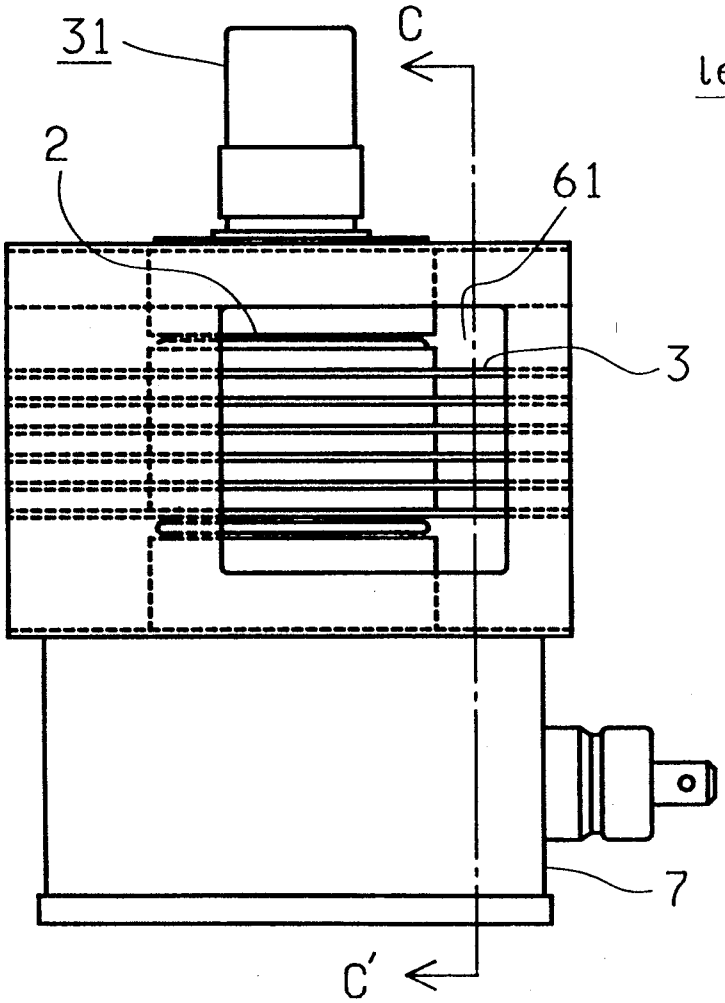

FIG. 4(*a*) is a side view illustrating side surface of a frame-like yoke perforated with a vent hole in a fourth embodiment. FIG. 4(*b*) is a sectional view taken substantially along the line C—C' of FIG. 4(*a*). Designated at 41 is a magnetron including a stem member 32, provided at the lower end of anode cylinder 2 incorporating an unillustrated a cavity resonator, for holding a cathode and an output member 6, provided at an upper end of the anode cylinder, for leading out the microwaves. Fitted to outer peripheries of the stem member 32 and of the output member 6 are tabular permanent magnets 4 perforated with holes each having an inside diameter nearly equal to an outside diameter of the stem member 32 and of the output member 6. An end surface, on the side of the anode cylinder, of each permanent magnet is brought into contact with an end surface of each of magnetic pole pieces disposed at both ends of the anode cylinder for the purpose of generating a tube-axial magnetic field in an interaction space within the anode cylinder. The cooling fins 3 are fixed to the outer periphery of the anode cylinder 2. Yokes 35 and 36 surround the anode cylinder 2, the permanent magnets 4 and cooling fins 3 in a rectangularly frame-like configuration. The yokes 35 and 36 serve as a magnetic return path of interaction-space magnetic fluxes. Formed in a frame-like yoke surface parallel with the tubular axis, as illustrated in FIG. 4(*a*), is a vent hole 61 for discharging the cooling air which has changed its direction due to hindrance of the anode cylinder. Note that the numeral 7 in the Figures represents a filter case which encases a filter for preventing a leakage of unnecessary microwaves from the cathode input member of the magnetron.

Figure 5:
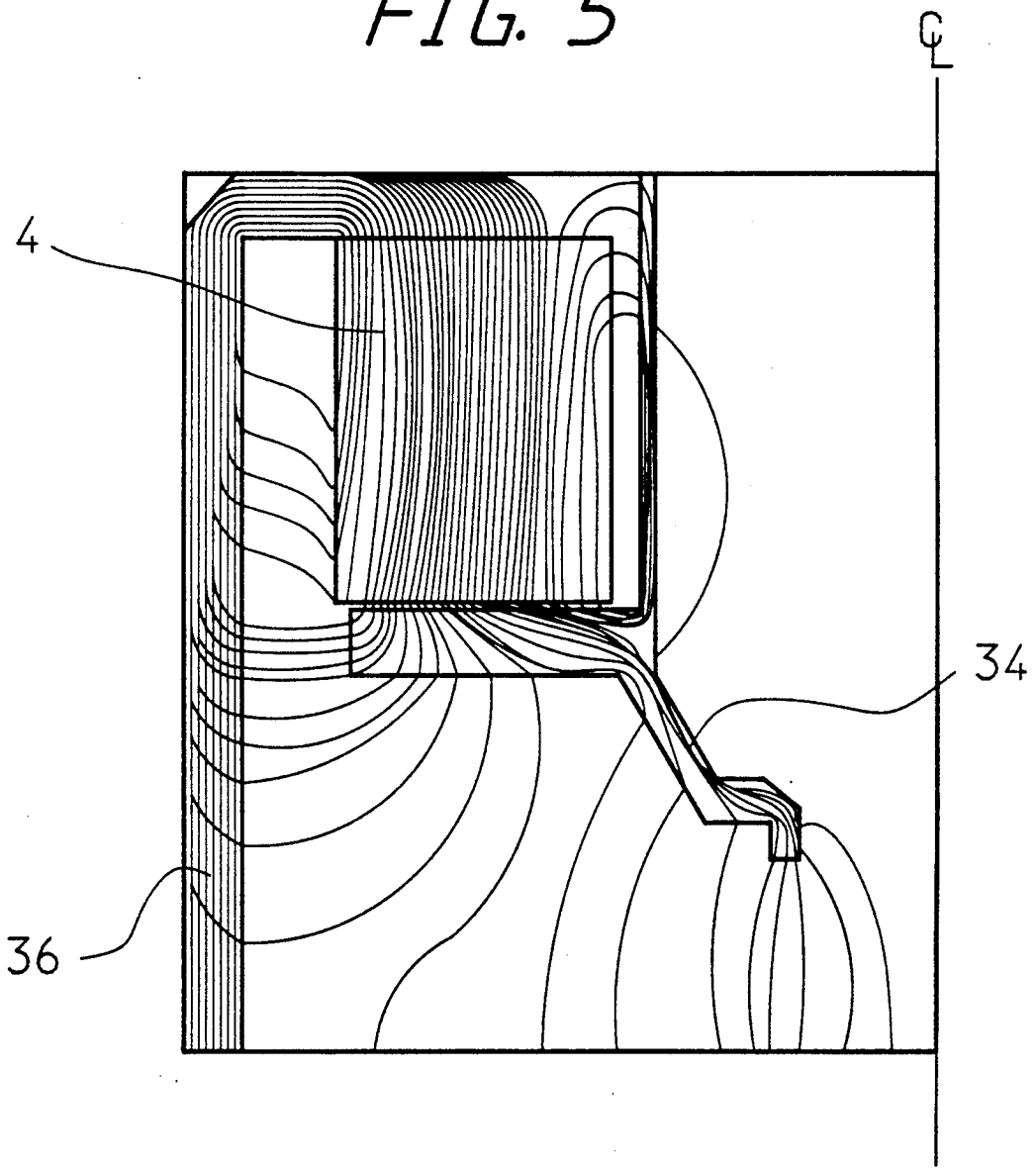
FIG. 5 is a result based on computer simulation, showing a state of leakage magnetic fluxes when the present invention is not applied.

As is obvious from FIG. 4(*b*), a lateral width of the magnetron, which is orthogonal to the ventilation flue, is reduced to the greatest possible degree with a view to miniaturizing the electronic cooking range. With this arrangement, the shortest distance between the inner surfaces of the yokes 35 and 36 and the outer surfaces of the permanent magnets 4 is less than one-half of a thickness t of the permanent magnets in the direction of the tubular axis. If the side surfaces (of an iron plate) of the yokes exist in a portion closest to the outer surfaces of the permanent magnets under such a condition, it follows that the yokes disposed in close proximity to the permanent magnets magnetized to generate different magnetic poles on both end surfaces in the thicknesswise direction thereof become a route of a good deal of leakage magnetic fluxes. Turning to FIG. 5, there is shown a computer simulation result of a state of the leakage magnetic fluxes. It is to be noted that the numeral 34 in FIG. 5 represents the above-mentioned magnetic pole pieces for leading the magnetic fluxes from the permanet magnets to the end portions of the interaction space within the anode cylinder. As a matter of fact, however, in accordance with the present invention, the vent hole of the yoke side surfaces extends nearly to a portion (of the shortest distance) standing vis-a-vis with the permanent magnet end on the side of the bulb body, and there exists no iron plate serving as a passageway of the leakage magnetic fluxes. Hence, a great amount of magnetic fluxes do not leak out via the yokes. Namely, a decline in intensity of the interaction-space magnetic field of the magnetron is restrained because of little leakage of magnetic fluxes outwardly of the interaction space. Incidentally, according to the present invention, a length in the tube-axial direction of the vent hole formed in the side surfaces of the yokes becomes long, but the cooling air flows more easily. Furthermore, a height h of a remaining part of the yoke with the vent hold perforated in its side surface is set to satisfy $h<t$, preferably $h<0.5$ t, the height h being measured from the inside surface of the top of the yoke to the upper edge of the vent hole as shown in FIG. 4(*b*).

As discussed above, in accordance with the present invention, there are obtained the magetron capable of making the most of the advantage of the miniaturized inverter power supply and the dielectric heater which uses the magnetron and exhibits a high efficiency of accommodating the materials for heating.

Besides, the dimension, orthogonal to the tubular axis as well as to the cooling air blowing direction, of the frame-like yoke of the magnetron for use with the electronic cooking range is reduced to the greatest possible degree. A ratio of a capacity of a food heating room to a total capacity of the electronic cooking range is increased as much as possible. This arrangement restrains the quantity of the leakage mangetic fluxes leading from the outer surfaces of the permanent magnets to the inner surfaces of the yokes and also prevents the decrease in intensity of the interaction-space magnetic field of the magnetron.

Although the illustrative embodiments of the present invention have been described in detail with reference to the accompanying drawings, it is to be understood that the invention is not limited to those precise embodiments. Various changes or modifications may be effected therein by one skilled in the art without departing from the scope or spirit of the invention.

What is claimed is:

1. A magnetron comprising:

a bulb body;

permanent magnets disposed at upper and lower ends of said bulb body;

cooling fins fixed to an outer periphery of an anode cylinder provided at a central portion of said bulb body; and yokes for surrounding said bulb body, said permanent magnets, and said cooling fins in a rectangularly frame-like configuration;

wherein:

cooling air is fed into a space defined by said yokes and is discharged from a vent hole perforated in a surface of said frame-like yokes which is parallel with a tubular axis of said anode cylinder after changing its direction due to hindrance from said anode cylinder;

a distance which is shortest between interior surface of said yokes which are parallel with the tubular axis and external surfaces of said permanent magnets is less than one-half of a thickness t of said permanent magnets in a direction of the tubular axis of said anode cylinder; and a height h of a remaining part of said yokes is set such that $h<t$, with h being measured from an upper edge of the vent hole to an inside surface of a top of said yokes.

2. A magnetron as set forth in claim 1, wherein said height h and said thickness t satisfy the relationship of $h \leqq 0.5$ t.

* * * * *